US005520599A

United States Patent [19]

Chen

[11] Patent Number: 5,520,599

[45] Date of Patent: May 28, 1996

[54] HORSE-RIDING SIMULATING EXERCISER HAVING TWO MODES OF OPERATION

[76] Inventor: Paul Chen, No. 3-6, Ching Yang Road, Liu Pao Village, Ta Ya Hsiang, Taichung Hsien, Taiwan

[21] Appl. No.: 422,246

[22] Filed: Apr. 14, 1995

[51] Int. Cl.[6] ..... A63B 21/068

[52] U.S. Cl. ..... 482/96; 482/72

[58] Field of Search ..... 482/72, 95, 96

[56] References Cited

U.S. PATENT DOCUMENTS 2,252,156 8/1941 Bell ..... 482/96
2,642,288 6/1953 Bell ..... 482/96
5,131,895 7/1992 Rogers, Jr. ..... 482/72
5,299,997 4/1994 Chen ..... 482/72

*Primary Examiner*—Lynne A. Reichard
*Attorney, Agent, or Firm*—Charles E. Baxley

[57] ABSTRACT

An exerciser includes a track arranged above the rear portion of a base. A lever includes a rear portion slidably engaged in the track. A seat post includes a front portion pivotally coupled to the base, includes a middle portion pivotally coupled to the lever. A foot post includes a lower portion pivotally coupled to the base. A link pivotally couples the foot post to the lever. A bar is secured to the lever for conducting pull type horse riding type exercises, and the bar is secured to the foot post for conducting push type horse riding type exercises.

3 Claims, 5 Drawing Sheets

HORSE-RIDING SIMULATING EXERCISER HAVING TWO MODES OF OPERATION

BACKGROUND OF THE INVENTION

1. Field of the Invention

The present invention relates to an exerciser, and more particularly to a horse-riding type exerciser convertible to both pull type and push type exercises.

2. Description of the Prior Art

Various kinds of horse riding type exercisers have been developed. Four prior arts are disclosed in U.S. Pat. No. 5,342,269 to Huang et al. issued Aug. 30, 1994; U.S. Pat. No. 5,356,357 to Wang et al. issued Oct. 18, 1994; U.S. Pat. No. 5,356,358 to Chen issued Oct. 18, 1994; and U.S. Pat. No. 5,366,428 to Liao issued Nov. 22, 1994.

However, the typical horse riding type exercisers are pull type exercisers, i.e., the handle bar may be pulled for conducting horse riding type exercises. The exercisers may not be used for conducting push type exercisers.

The present invention has arisen to mitigate and/or obviate the afore-described disadvantages of the conventional horse riding type exercisers.

SUMMARY OF THE INVENTION

The primary objective of the present invention is to provide a convertible horse-riding type exerciser which can be used for conducting both pull type and push type horse riding exercises.

In accordance with one aspect of the invention, there is provided a horse riding type exerciser comprising a base including a front portion having a pivot shaft provided therein and a rear portion, a rod supported above the rear portion of the base and arranged in parallel to the base so as to form a track means between the rod and the base, a sliding means slidably engaged in the track means, a lever means including a rear and lower portion pivotally coupled to the sliding means so as to be movable along the track means, and including a front and upper portion, a bar including a first end secured in the front and upper portion of the lever means by a bolt means and including a second end for supporting handle means thereon, a seat post means including a front and lower portion pivotally coupled to the front portion of the base at the pivot shaft, including a middle portion pivotally coupled to the lever means at a pivot axle, and including a rear and upper portion having a seat cushion provided thereon, a foot post means including a lower portion pivotally coupled to the pivot shaft and including an upper portion having a foot support means provided thereon, and link means pivotally coupling the foot post means to the lever means. The seat post means is rotated relative to the pivot shaft, the lever means is rotated relative to the seat post means about the pivot axle and the sliding means being slidably moving along the track means so as to simulate horse-riding actions. The bar is secured to the lever means for conducting pull type horse riding type exercises, and the bar is secured to the foot post means for conducting push type horse riding type exercises.

A back support is secured to the lever means and moved in concert with the lever means. A cover means is provided for covering the rod and the track means.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

A horse-riding type exerciser in accordance with the present invention may be used for conducting both pull type and push type horse riding exercises. A copending U.S. Patent Application was filed on Jun. 7, 1994 with the application Ser. No. 08/272,767, now allowed. The co-pending U.S. Patent Application is taken as a reference. The present invention is provided to simplify the configuration and to reduce the manufacturing cost of the co-pending application.

Figure 1:
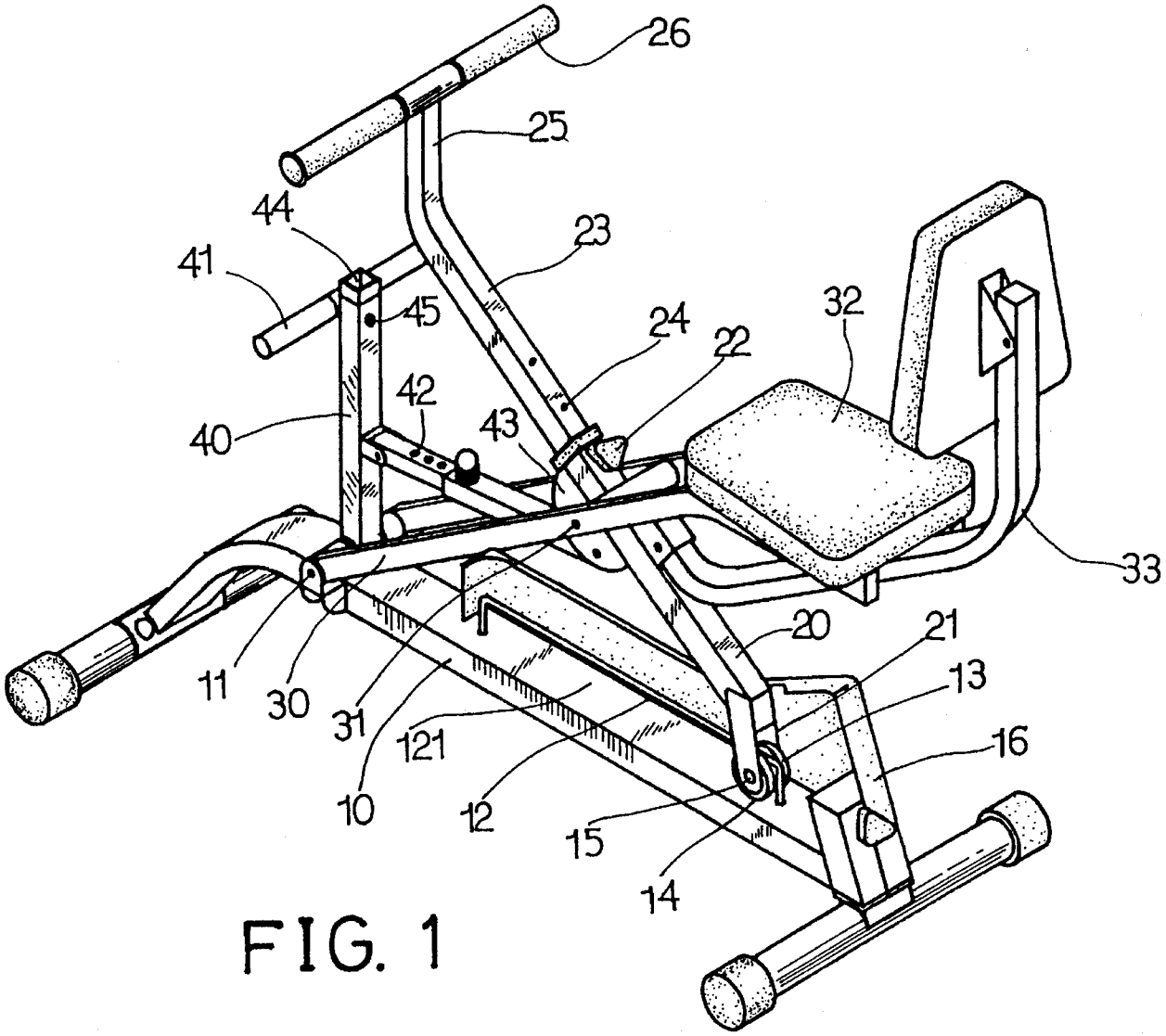
FIG. 1 is a perspective view of a horse-riding type exerciser in accordance with the present invention.
Figure 2:
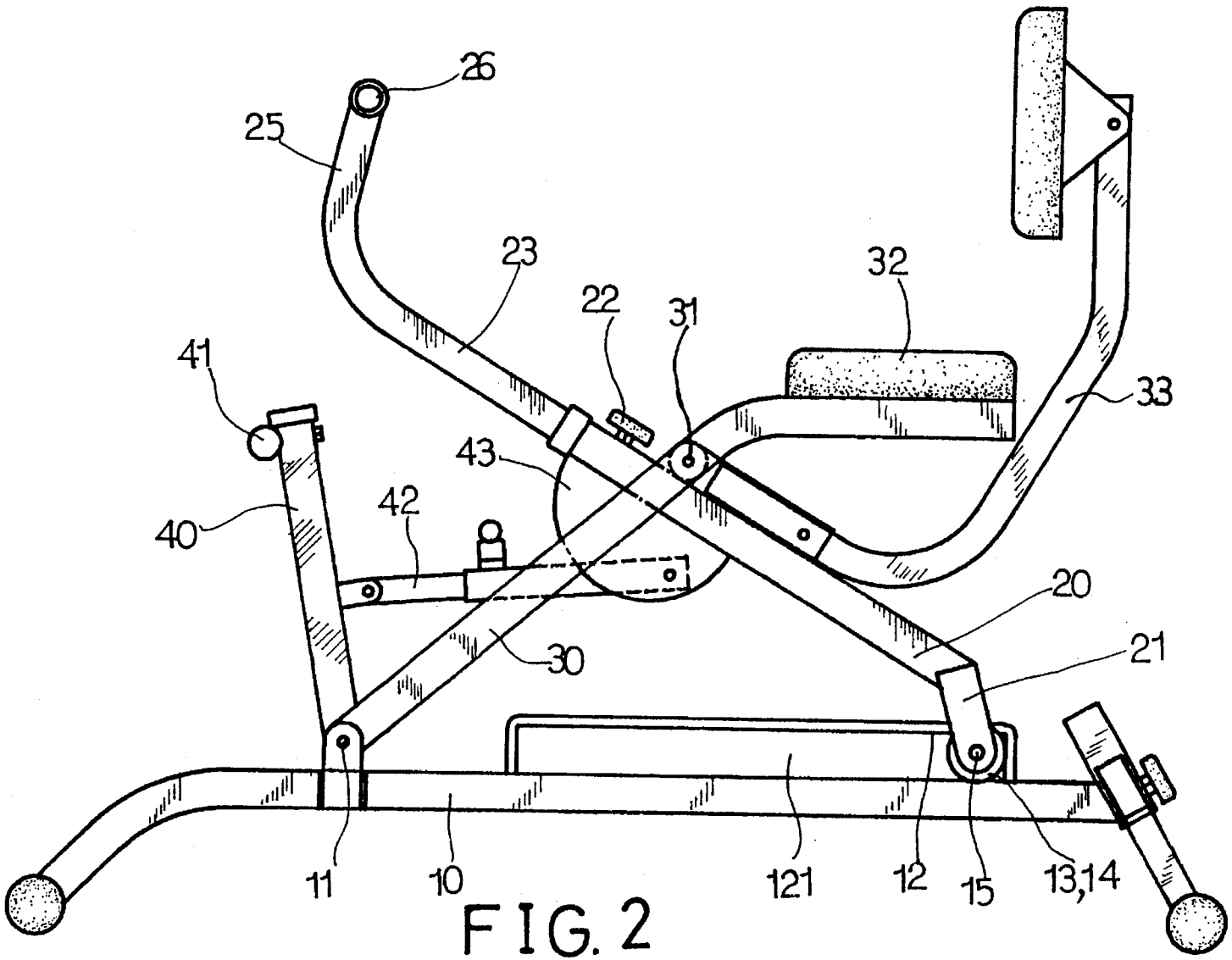
FIGS. 2, 3, 4 and 5 are plane views illustrating the operation of the convertible horse-riding type exerciser.

Referring to the drawings, and initially to FIGS. 1 and 2, the exerciser in accordance with the present invention comprises a base 10 including a longitudinal beam having a pivot shaft 11 laterally provided in the front portion thereof and a rod 12 disposed above the rear portion of the beam 10 and extended in parallel to the beam 10 so as to form a track means 121. A roller 13 is rotatably and movably engaged in the track means 121 and preferably includes two side discs 14 for engaging with the beam 10 so as to allow smooth moving of the roller 13 in the track means 121. The roller 13 includes a pivot pin 15 provided in the center portion thereof. A cover means 16 is provided for covering the rod 12 and the track means 121.

A lever 20 includes a pair of lugs 21 provided in the rear and lower end for pivotally coupling to the roller 13 at the pivot pin 15 such that the rear end of the lever 20 may move longitudinally along the track means 121. The lever 20 includes a bolt means 22 provided in the upper front end thereof. A bar 23 is slidably engaged in the upper front end of the lever 20 and includes a number of holes 24 for engaging with the bolt means 22 such that the bar 23 may be adjusted to suitable length relative to the lever 20. The bar 23 includes a post 25 extended upward therefrom for supporting a pair of handles 26.

A seat post 30 includes a pair of parallel sticks having a front and lower portion pivotally coupled to the pivot shaft 11 such that the seat post 30 may be rotated relative to the base 10 at the pivot shaft 11. The seat post 30 includes an intermediate portion pivotally coupled to the lever 20 at a pivot axle 31 such that the seat post 30 may be rotated relative to the lever 20 at the pivot axle 31. The seat post 30 includes a seat cushion 32 provided on the rear and upper portion thereof. A back support 33 is fixed on the lever 20 and rotated in concert with the lever 20. It is to be noted that the back support 33 is directly secured to the lever 20 and does not need a further link means for coupling the back support 33 to the seat cushion 32.

A foot post 40 has a lower end pivotally coupled to the pivot shaft 11 and has a pair of foot supports 41 provided on the upper portion for supporting the feet of the users. A pair of panels 43 are secured to the bottom of the front and upper portion of the lever 20. A link 42 pivotally couples the foot post 40 to the lever 20 at the panels 43. It is preferable that the link 42 includes an adjustable configuration for adjusting to suitable length between the foot post 40 and the lever 20. The foot post 40 includes an open top 44 for engaging with the bar 23 and includes a screw hole 45 provided in the upper portion thereof.

Figure 3:
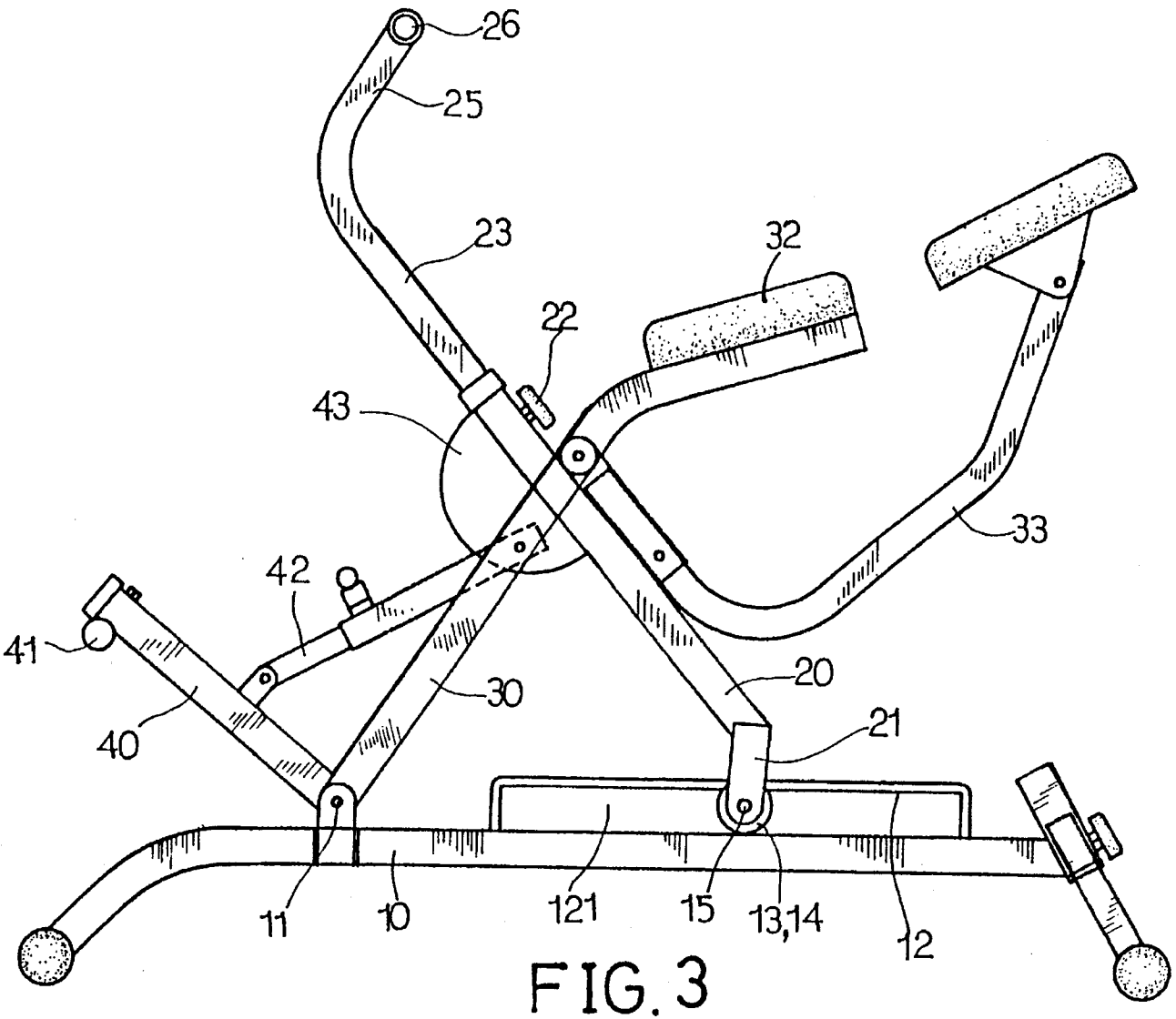

In operation, as shown in FIGS. 2 and 3, the lower end of the bar 23 is secured in the front and upper portion of the lever 20. At this moment, the exerciser may be used for conducting pull type horse riding exercises. As shown in FIG. 2, when the handles 26 are pulled by the users and/or when the foot supports 41 are forced or stepped by the feet of the users the seat post 30 may be rotated counterclockwise by the lever 20 against the weight of the users such that the users may be caused to move upward for simulating pull type horse-riding action, as shown in FIG. 3. When the force applied to the handles 26 and/or the foot supports 41 is released, the seat cushion 32 may move downward to the position as shown in FIG. 2 again.

Figure 4:
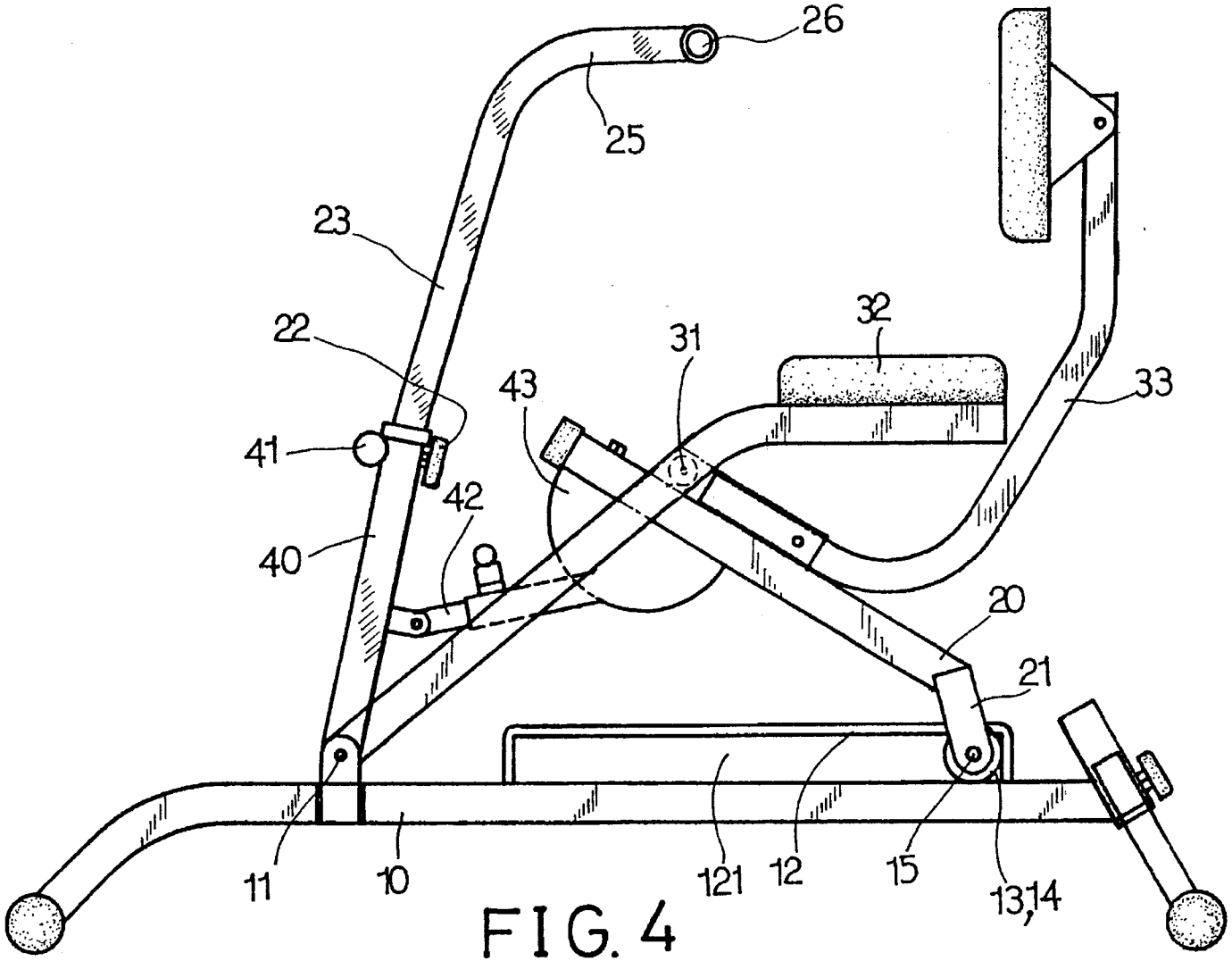
Figure 5:
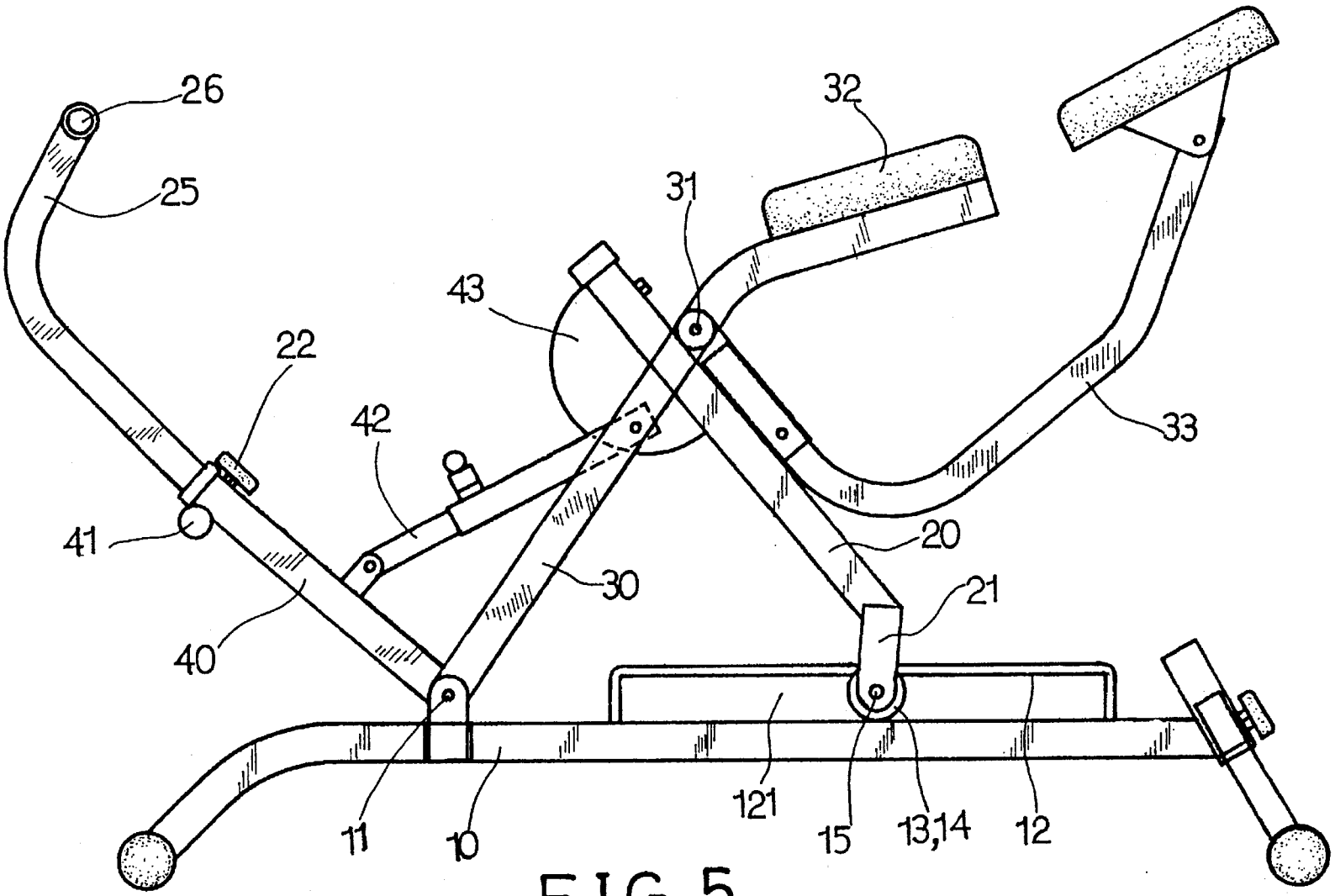

As shown in FIGS. 4 and 5, the bar 23 is disengaged from the lever 20 and is secured in the open top 44 of the foot post 40 by the bolt means 22. At this moment, the exerciser may be used for conducting push type horse riding exercises. When the handles 26 are pushed by the users from the position as shown in FIG. 4, the post 30 may be rotated counterclockwise by the lever 20 against the weight of the users such that the users may be caused to move upward for simulating push type horse-riding action. When the force applied to the handles 26 is released, the users may move downward to the rest position.

Accordingly, the horse-riding type exerciser in accordance with the present invention can be used for conducting both pull type and push type horse riding exercises. The exerciser includes a simplified track means and includes a simplified back support as compared with the co-pending US application.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A horse riding simulating exerciser comprising:

a base including a front portion having a pivot shaft provided therein and a rear portion, a rod supported above said rear portion of said base and arranged in parallel to said base so as to form a track means between said rod and said base, a sliding means slidably engaged in said track means, a lever means including a rear and lower portion pivotally coupled to said sliding means so as to be movable along said track means, and said lever means including a front and upper portion, a bar including a first end engaged in said front and upper portion of said lever means and including a bolt means for securing said first end of said bar to said front and upper portion of said lever means, and said bar including a second end for supporting handle means thereon, a seat post means including a front and lower portion pivotally coupled to said front portion of said base at said pivot shaft, including a middle portion pivotally coupled to said lever means at a pivot axle, and including a rear and upper portion having a seat cushion provided thereon, a foot post means including a lower portion pivotally coupled to said pivot shaft and including an upper portion having a foot support means provided thereon, said foot post means including an open top for receiving and for engaging with said first end of said bar, said bolt means being engaged with said foot post means and said bar for securing said bar to said foot post means, and link means pivotally coupling said foot post means to said lever means, said seat post means being rotated relative to said pivot shaft, said lever means being rotated relative to said seat post means about said pivot axle and said sliding means being slidably movable along said track means so as to simulate horse-riding actions, said bar being secured to said lever means for rotating said lever means about said pivot axle and for moving said sliding means along said track means, and said bar being secured in said open top of said foot post means for rotating said foot post means about said pivot shaft and for rotating said lever means about said pivot axle by said link means so as to move said sliding means along said track means.

2. An exerciser according to claim 1 further comprising a back support secured to said lever means and moved in concert with said lever means.

3. An exerciser according to claim 1 further comprising a cover means for covering said rod and said track means.

* * * * *